US006645086B1

(12) United States Patent
Chen

(10) Patent No.: US 6,645,086 B1
(45) Date of Patent: Nov. 11, 2003

(54) COMPOUND GOLF CLUB HEAD

(76) Inventor: Arthur C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 10/180,089

(22) Filed: Jun. 27, 2002

(51) Int. Cl.[7] ..... A63B 53/04

(52) U.S. Cl. ..... 473/335; 473/345; 473/347; 473/349

(58) Field of Search ..... 473/324, 345, 473/346, 347, 348, 349, 350, 342, 338, 335, 329, 326, 332, 305, 306, 307

(56) References Cited

U.S. PATENT DOCUMENTS 1,355,889 A * 10/1920 Campbell
3,692,306 A * 9/1972 Glover
4,877,249 A * 10/1989 Thompson
5,328,176 A * 7/1994 Lo
5,410,798 A * 5/1995 Lo
5,425,538 A * 6/1995 Vincent
5,509,660 A * 4/1996 Elmer
5,511,787 A * 4/1996 Baum
5,624,331 A * 4/1997 Lo
5,669,827 A * 9/1997 Nagamoto
6,010,411 A * 1/2000 Reyes
6,071,200 A * 6/2000 Song
6,238,300 B1 * 5/2001 Igarashi
6,334,817 B1 * 1/2002 Ezawa

* cited by examiner

*Primary Examiner*—Sebastiano Passaniti
(74) *Attorney, Agent, or Firm*—Browdy and Neimark, P.L.L.C.

(57) ABSTRACT

A golf club head is constructed to include a hollow casing molded from a compound material, an L-shaped thin sheet of metal packing plate and a cover plate. The casing has a front face, a bottom face, a back face, a toe, a heel, a neck, and a top open side. The packing plate is fixedly fastened to the front face and bottom face of the casing, thereby forming a face panel and a sole for the golf club head. The cover plate is fixedly fastened to the casing and covered the top open side of the casing.

7 Claims, 4 Drawing Sheets

COMPOUND GOLF CLUB HEAD

BACKGROUND OF THE INVENTION

1. Field of the Invention:

The present invention relates to golf clubs and, more specifically, to a compound material golf club head.

2. Description of the Related Art:

The club head of a conventional wood golf club has a face panel cast from metal such as stainless steel. During casting, bubbles may be produced in the face panel. A golf club head of this design is not durable in use. When striking the ball heavily, the face panel will curve slightly inwards, affecting the control of the flying direction of the ball. A golf club head of compound material, for example, fiber reinforced epoxy resin is hard enough, however it wears quickly at the hitting grooves disposed on the face panel when in use. The leading edge of the bottom of the casing of this design of golf club head tends to be damaged easily because it is frequently forced into the soil during the game.

SUMMARY OF THE INVENTION

It is the main object of the present invention to provide a golf club head, which has metal means to protect the leading edge.

It is another object of the present invention to provide a golf club head, which has a wear-resistant face panel such that the hitting grooves disposed on the face panel do not wear quickly with use.

To achieve these objects of the present invention, the golf club head comprises a hollow casing molded from compound materials, such as carbon fibers or carbon fiber reinforced resin, an L-shaped thin sheet of metal packing plate and a cover plate. The casing has a front face, a bottom face, a back face, a toe, a heel, a neck, and a top open side. The packing plate is fixedly fastened to the front face and bottom face of the casing, thereby forming a face panel and a sole for the golf club head. The cover plate is fixedly fastened to the casing and covered the top open side of the casing.

DETAILED DESCRIPTION OF THE PREFERRED EMBODIMENT

Figure 1:
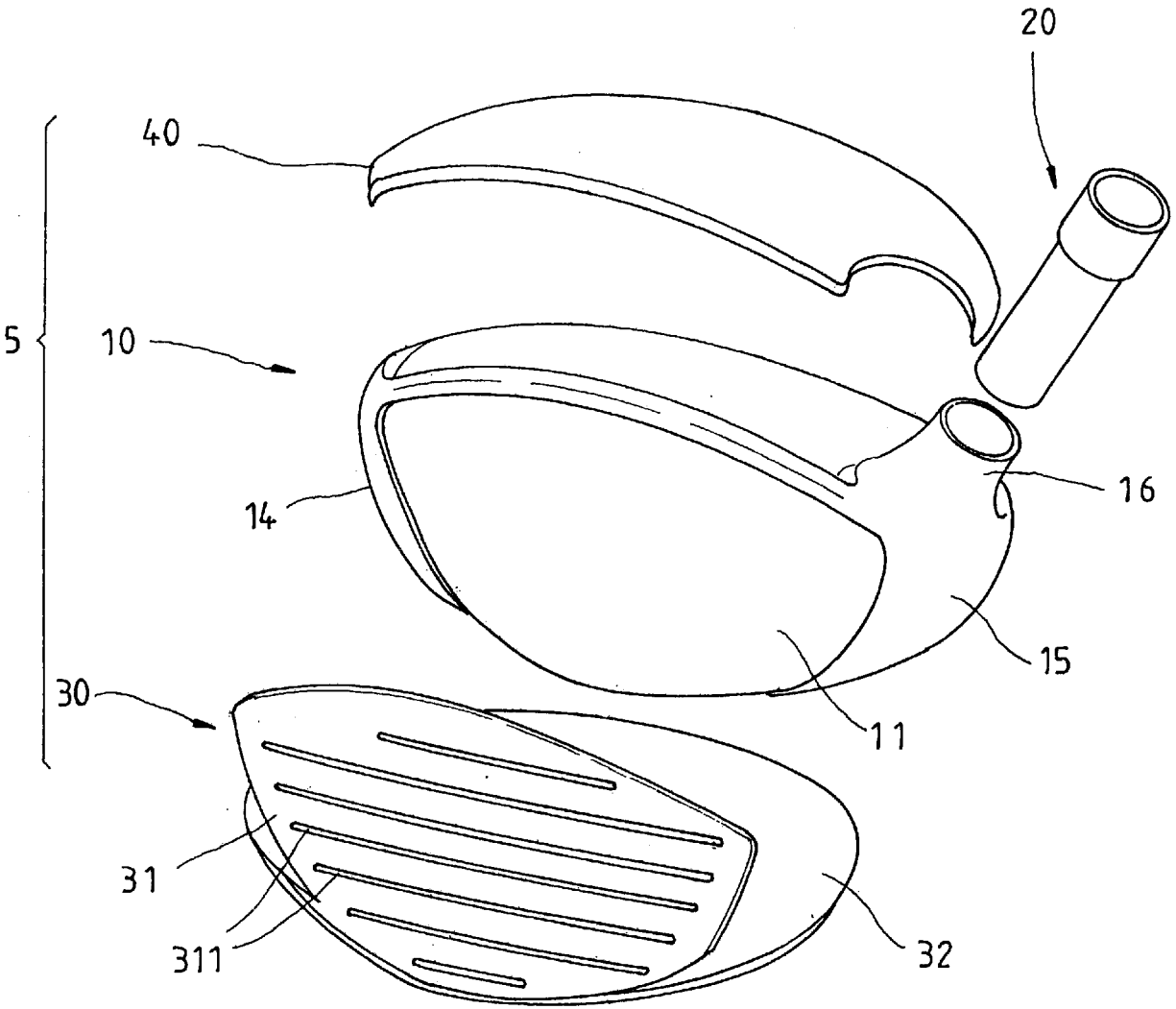
FIG. 1 is an exploded view of a golf club head according to a first preferred embodiment of the present invention.
Figure 2:
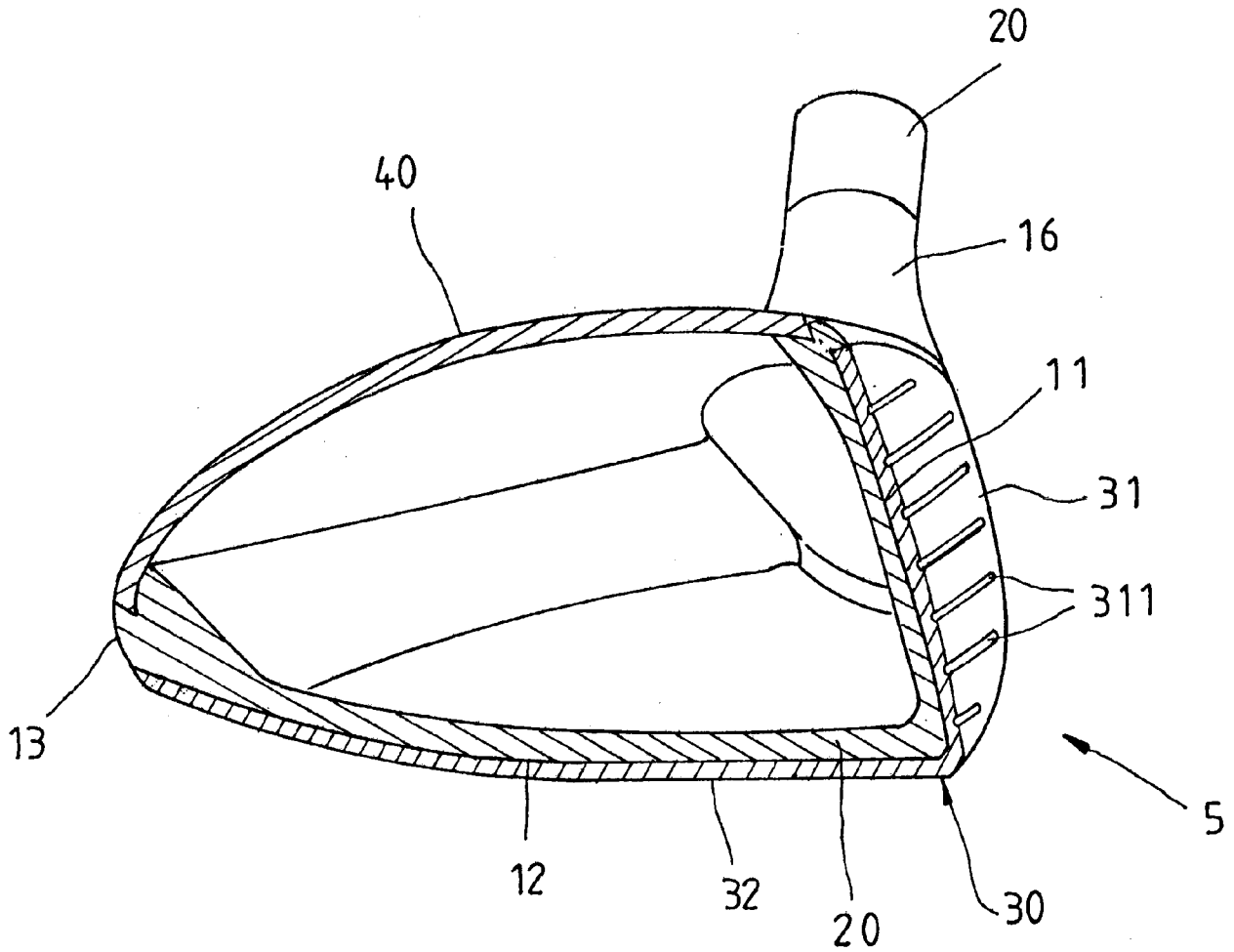
FIG. 2 is a sectional assembly view of the golf club head according to the first preferred embodiment of the present invention.

Referring to FIGS. 1 and 2, a golf club head 5 provided by a first preferred embodiment of the present invention is shown comprised of a casing 10, an axle tube 20, a packing plate 30, and a cover plate 40.

The casing 10 is made of a compound material, such as a carbon fiber reinforced compound, carbon fiber reinforced epoxy resin, etc., subject to a predetermined shape. The casing 10 has a front face 11, a bottom face 12, a back face 13, a toe 14, a heel 15, and a neck 16. The inside of the casing 10 is hollow. The top side of the casing 10 is opened.

The axle tube 20 is a stepped metal tube fitted into the neck 16 of the casing 10 for receiving a club shaft (not shown).

The packing plate 30 is a substantially L-shaped thin sheet of metals fixedly fastened to the front face 11 and bottom face 12 of the casing 10, forming the face panel 31 and sole 32 of the golf club head 5. The face panel 31 has a plurality of hitting grooves 311 thereon.

The cover plate 40 is fixedly fastened to the casing 10 to close the opened top side of the casing 10.

Figure 3:
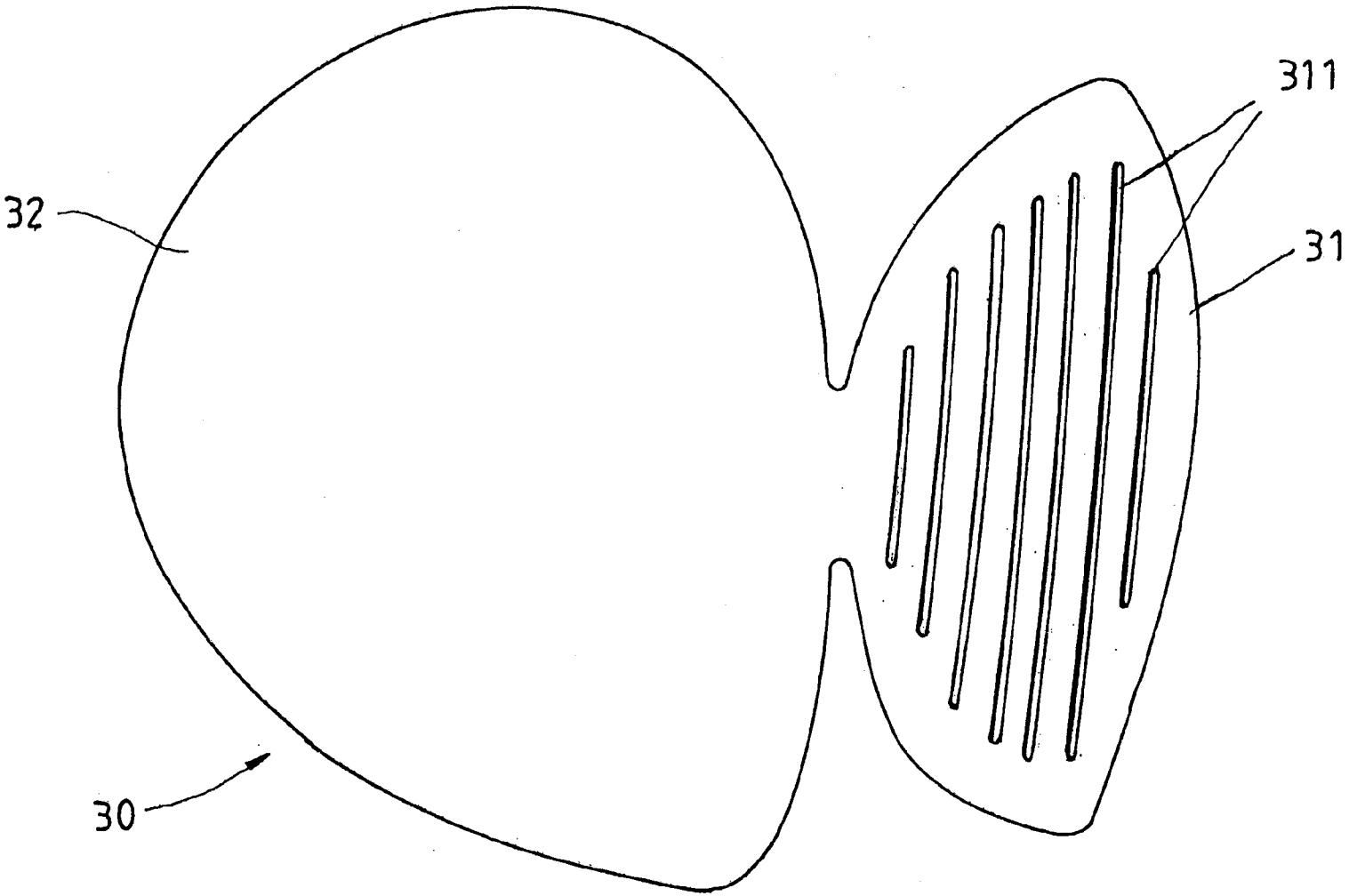
FIG. 3 is a top extended view of the metal packing plate for the golf club head according to the first preferred embodiment of the present invention.

During fabrication, a thin sheet of metal is obtained through a roller ramming process and then stamped into the packing plate 30 having hitting grooves 311 as shown in FIG. 3, the packing plate 30 is then bent into "L" shape. The packing plate 30 thus obtained is then put in the mold, and then Bulk Molding Compound (B.M.C.) of carbon fiber reinforced epoxy is put into the mold and molded with the desired casing 10 on the packing plate 30. The cover plate 40 can be molded from carbon fibers or hard plastic material, and then fixedly covered on the top side of the casing 10.

Figure 4:
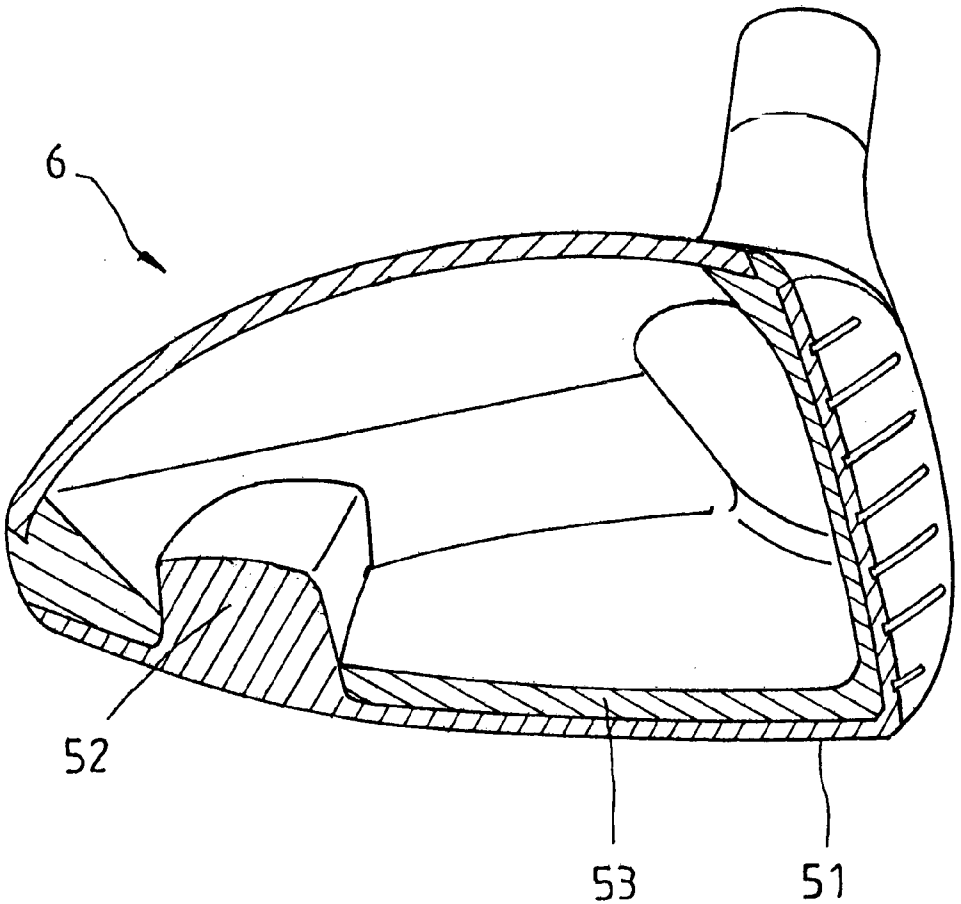
FIG. 4 is a sectional view of a golf club head according to a second preferred embodiment of the present invention.

According to a second preferred embodiment of the present invention as shown in FIG. 4, a weight 52 is welded to the packing plate 51, and then the desired casing 53 is molded on the packing plate 51. Because of the effect of the weight 52, the center of gravity is shifted backwards and downwards.

AS indicated above, the packing plate and the casing are molded in integrity. The shape and thickness of the casing can be precisely controlled as designed. Further, because the packing plate is a metal member, the hitting grooves in the face panel do not wear quickly with the use of the golf club Further, because the bottom side of the face panel and the leading edge of the club head are well protected by the metal packing plate, the club head does not wear quickly. The fabrication of the face panel by means of roller ramming and stamping is easy and simple without producing bubbles.

What is claimed is:

1. A golf club head comprising:

a hollow casing made from a compound material, said casing having a front face, a bottom face, a back face, a toe, a heel, a neck, and a top open side;

an L-shaped thin sheet of metal packing plate fixedly fastened to the front face and bottom face of said casing and forming a face panel and a sole for the golf club head; and a cover plate fixedly fastened to said casing and covering the top open side of said casing.

2. The golf club head as claimed in claim 1 further comprising a metal axle tube fixedly fastened to the neck of said casing.

3. The golf club head as claimed in claim 1, wherein said casing is made from carbon fibers.

4. The golf club head as claimed in claim 1, wherein said casing is made from carbon fiber reinforced epoxy resin.

5. The golf club head as claimed in claim 1, wherein said cover plate is made from carbon fibers.

6. The golf club head as claimed in claim 1, wherein said cover plate is made from plastics.

7. The golf club head as claimed in claim 1, wherein said packing plate has a weight fixedly fastened to a part therefore for said sole.

* * * * *